United States Patent [19]

Hamamura et al.

[11] Patent Number: 4,790,391

[45] Date of Patent: Dec. 13, 1988

[54] AIR PRESSURE IMPACT DRILLING METHOD AND APPARATUS FOR SAME

[75] Inventors: Hiroyuki Hamamura, Saitama; Hiroyuki Kawasaki; Taro Watanabe, both of Tokyo, all of Japan

[73] Assignee: Tone Boring Co., Ltd., Tokyo, Japan

[21] Appl. No.: 911,251

[22] Filed: Sep. 24, 1986

[30] Foreign Application Priority Data

Oct. 4, 1985 [JP] Japan ..... 60-221566
Mar. 5, 1986 [JP] Japan ..... 61-47540

[51] Int. Cl.[4] ..... B25D 17/14

[52] U.S. Cl. ..... 173/57; 173/73; 173/78; 175/207

[58] Field of Search ..... 173/134, 135, 57, 74, 173/73, 78, 79; 175/415, 417, 108, 207, 209

[56] References Cited

U.S. PATENT DOCUMENTS 3,870,113 3/1975 Slawson ..... 173/101
4,401,168 8/1983 Claringbull ..... 173/57 X

*Primary Examiner*—Frank T. Yost
*Assistant Examiner*—Willmon Fridie, Jr.
*Attorney, Agent, or Firm*—Koda and Androlia

[57] ABSTRACT

An air-pressure impact type drilling method and an apparatus for the same in which a piston of an air hammer drill is moved up and down by pressure air to produce impact energy and the impact energy of the piston is used to give impact vibrations repetitively to a drill bit. In the air-pressure impact type drilling method and the apparatus for the same, the air hammer drill is operated by the pressure air to be supplied from the ground, the air that has already been used for operation of the air hammer drill is exhausted onto the ground through an air exhaust pipe provided in a drilling pipe and communicating with an air exhaust passage formed in the air hammer drill, and substances cut out by the air hammer drill together with muddy water within the trench are discharged by means of a reverse circulation system while drilling on through the earth. As a result of this, even if the water head pressure acts on the tip end of the drill bit, the pressure of the air for operation of the piston will not be affected by such water head pressure and thus the drilling performance of the air hammer drill will not be ill affected even under the muddy water.

9 Claims, 10 Drawing Sheets

AIR PRESSURE IMPACT DRILLING METHOD AND APPARATUS FOR SAME

BACKGROUND OF THE INVENTION

1. Field of the Invention

The present invention relates to an air-pressure impact type drilling method and an apparatus for the same in which a piston of an air-actuated hammer drill is moved up and down by pressure air to produce impact energy which can be used to give repetitive impact vibrations to a drill bit, and, in particular, to such air-pressure impact type drilling method and apparatus for the same which can be used to drill through conglomerates, rocks and the like under muddy water.

2. Description of the Prior Art

An air-actuated down-the-hole hammer drill comprises a tubular casing for supporting a drill bit slidably in the axial direction at the tip end thereof, and a piston which is supported slidably in the axial direction thereof within the tubular casing to hit against the drill bit at the lower end thereof. There are formed two pressure chambers upwardly and downwardly of the piston respectively and these two up and down pressure chambers are alternately pressurized by pressure air from an external source to thereby move up and down the piston successively.

Conventionally, the pressure air used to operate a piston is jetted out from the tip end of a bit and the jetted air cleans the edge of the bit and at the same time blows cut-out slimes and the like up onto the ground while drilling (which is referred to as a dry boring method). The air-actuated hammer drill can provide high impact forces due to use of compressed air and is normally used to drill through the rocks.

However, when it is used under water, the conventional air pressure impact hammer drill of this type is found disadvantageous in several points. For example, in the case of drilling using muddy water or drilling under sea, a river, a dam or the like (which is referred to as a wet boring method), water head pressure is applied against the tip end of the bit to cause the muddy water or the like to flow backward into the air pressure chambers, thereby making the impact hammer drill inoperable. Also, even when the water head pressure does not reach the jetted-air pressure, the operating air pressure is decreased by the water head pressure. As result of this, the impact energy of the piston is lowered accordingly and thus the piston is not able to hit against the bit properly so that the drilling efficiency of the air hammer drill is worsened.

SUMMARY OF THE INVENTION

The present invention aims at eliminating the drawbacks found in the above-mentioned conventional air-actuated down-the-hole hammer drill system.

Accordingly, it is an object of the invention to provide an air-pressure impact type drilling method and an apparatus for the same in which the exhaust air already used to operate an air-actuated hammer drill can be flowed back through an air exhaust pipe in a drilling pipe onto the ground and the earth and sand cut out together with the muddy water in the trench can be discharged via a water discharge pipe in a drilling pipe onto the ground, whereby, even in the case of drilling under water, the drilling performance of the air-pressure impact type drilling apparatus will not be impaired as well as a large-diameter drilling operation can be carried out in an efficient manner.

In order to accomplish the above object, according to one aspect of the invention, there is provided an air-pressure impact type drilling method in which the air-actuated hammer drill is driven by the pressure air to be supplied from a source provided on the ground, the air after use for operation of the air hammer drill is flowed back onto the ground through the air exhaust pipe provided in the drilling pipe and communicating with an air exhaust passage in the air hammer drill, and substances cut out are discharged by means of a reverse circulation system while drilling on through the earth. This drilling method is herein referred to as a "MACH" (Mud and Air Circulation Hammer) method.

In order to accomplish the above object, according to another aspect of the invention, there is provided an air-pressure impact type drilling apparatus in which there are secured to a casing one or more air hammer drills parallel to one another, each air hammer drill being adapted to carry out its drilling operation with the bit thereof given impact vibrations by a piston operable by means of the pressure air from the ground, and the casing is provided with an air feed passage for supplying the pressure air to the air hammer drill, an air exhaust passage communicating with an air exhaust hole for the exhaust air already used for the operation of the piston of the air hammer drill to discharge the exhaust air onto the ground, and a water discharge passage formed adjacent to the bit of the air hammer drill to transport and discharge the earth and sand cut out by the bit.

In attaining the above object, according to a further aspect of the invention, there is provided an air-pressure impact type drilling apparatus for drilling through the earth by giving impact vibrations to its bit with the lower end of a piston operable by means of pressure air from the ground, wherein the above-mentioned piston is formed hollow, there is formed an air exhaust hole in the upper portion of the piston opposed to the lower end of the piston in such a manner that it communicates with the hollow portion of the piston, one or more air-actuated hammer drills are parallel secured to a casing, each air hammer drill being adapted to discharge the exhaust air already used for operation of the piston from the air exhaust hole directly or via the piston hollow portion, and the casing includes an air feed passage for supplying the pressure air to the air hammer drill(s) from an air feed pipe provided in a drilling pipe, an air exhaust passage for connecting the air exhaust pipe in the drilling pipe with the above-mentioned air exhaust hole, and a water discharge passage having a lower end opened adjacent to the bit and being adapted to suck in the earth and sand cut out by the bit as well as water.

It is another object of the invention to provide an air-pressure impact type drilling apparatus which will not leave any uncut portions under an earth discharge passage and also prevents the suction port of the water discharge passage from being blocked up with conglomerates or the like.

In order to achieve this object, according to the invention, there is provided an air-pressure impact drilling apparatus in which one or more air-actuated hammer drills operable by pressure air supplied from the ground are secured in parallel to one another, and there are formed an air feed passage for supplying the pressure air to the air hammer drill(s) and an air exhaust passage for exhausting up to the ground the exhaust air that has been used for operation of the air hammer drill(s), characterized in that there are provided a bit for the air-pressure impact drilling apparatus and a water discharge passage formed in the drilling center portion of the bit and having a suction port for sucking substances cut out by the bit, and a portion of the cutter of the bit is formed so as to extend up to a position located downwardly and substantially centrally of the suction port.

BRIEF DESCRIPTION OF THE DRAWINGS

The exact nature of this invention, as well as other objects and advantages thereof, will be readily apparent from consideration of the following specification relating to the accompanying drawings, in which like reference charactors designate the same or similar parts throughout the figures thereof and wherein.

DETAILED DESCRIPTION OF THE INVENTION

Detailed description will hereunder be given of the preferred embodiments of an air-pressure impact type drilling method and an apparatus for the same according to the present invention with reference to the accompanying drawings.

Figure 1:
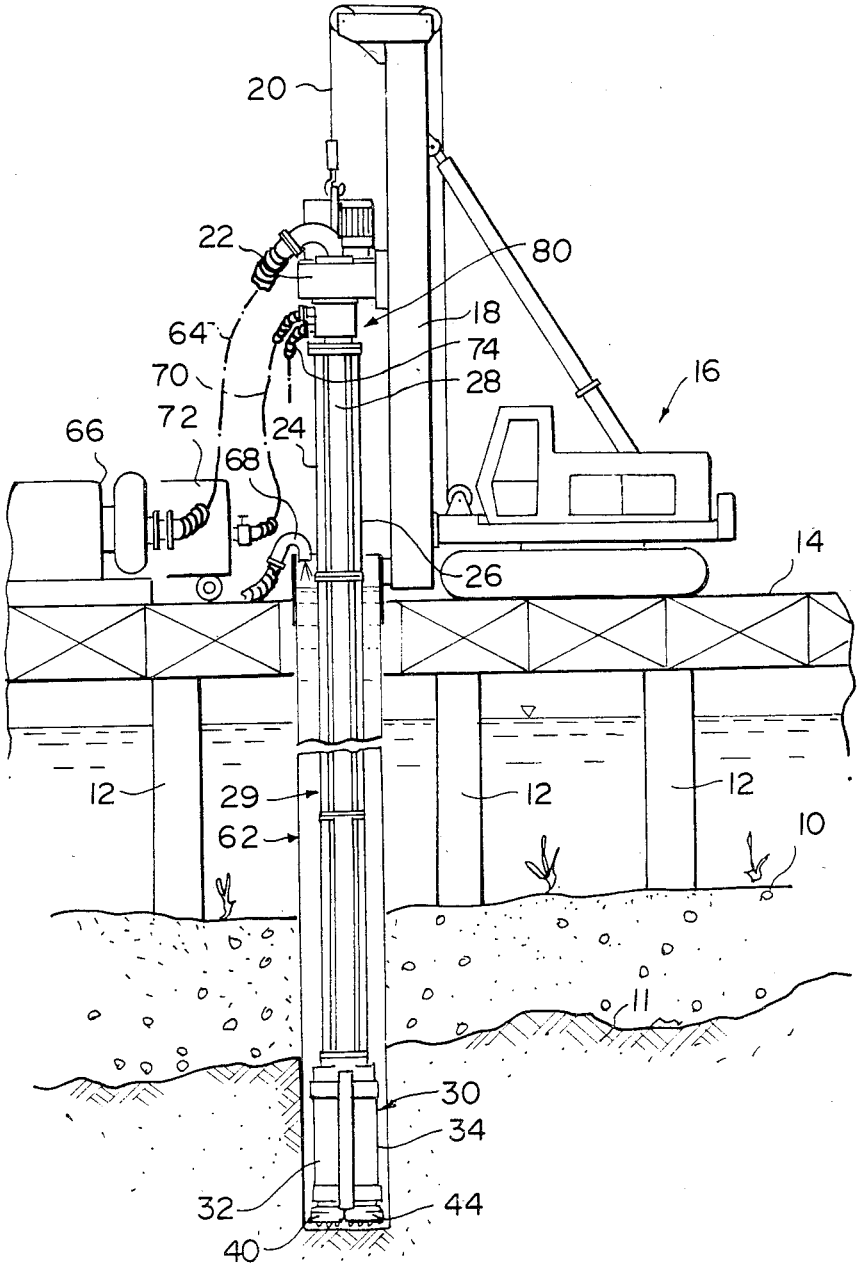
FIG. 1 is a working view of an embodiment of an air-pressure impact drilling method and an apparatus for the same in accordance with the present invention.

Referring first to FIG. 1, there is shown a working view of an air-pressure impact type drilling device according to the invention. In this figure, support piles 12 are put up on the surface soil layer 10 of the sea bottom and a stage 14 is constructed on the support piles 12. Also, in order to prevent the surface soil layer 10 being destroyed, a casing pipe 62 is planted down into a rock bed 11. On the stage 14 there is created a leader 18 which is provided in a base machine 16, and the leader 18 is provided via a rope 20 with a rotary drive device 22 and a swivel device 80 such that they are free to slide in a vertical direction. To the swivel device 80 there is supported a drilling pipe comprising an air feed pipe 24, an air exhaust pipe 26 and a water discharge pipe 28 in such a manner that it can be moved integrally with the swivel device. At the lower end of the drilling pipe there is provided through a seal member by bolting or similar means an air-pressure impact type drilling apparatus 30 according to the present invention.

Figures 2, 3, 4, 5:
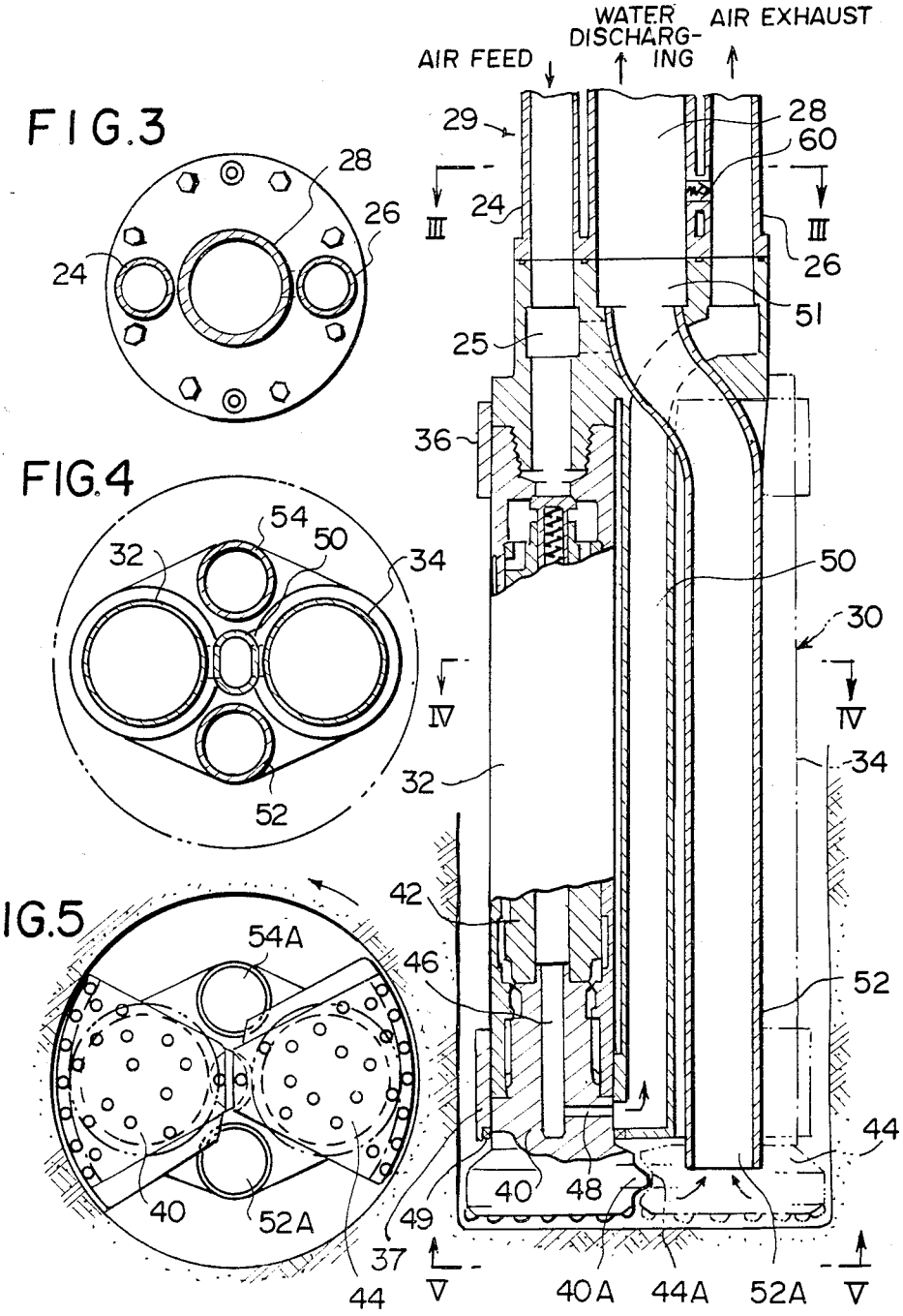
FIG. 2 is a section view to show the structure of the air-pressure impact type drilling apparatus in accordance with the invention.
FIG. 3 is a section view taken along the line III—III in FIG. 2.
FIG. 4 is a section view taken along the line IV—IV in FIG. 2.
FIG. 5 is a bottom view taken along the line V—V in FIG. 2.

The structure of the air-pressure impact type drilling apparatus 30 according to the invention is shown in detail in FIG. 2 through FIG. 5; FIG. 3 is a section view taken along the line III—III in FIG. 2; FIG. 4 is a section view taken along the line IV—IV in FIG. 2; and, FIG. 5 is a bottom view taken along the line V—V in FIG. 2. The air-pressure impact type drilling apparatus 30 includes a plurality of air hammer drills, for example, air hammer drills 32, 34 and these air hammer drills 32, 34 are secured parallel to each other by upper and lower casings 36, 37, respectively. The lower end of the air hammer drill 32 is fixed through a seal member 49 to the lower portion of the casing 37 and the air hammer drill 32 includes a bit 40 supported by means of spline connection or the like such that it is free to slide by a given amount in the axial direction. Upwardly of the bit 40 there is arranged a piston 42 which can be moved up and down with pressure air. This piston 42 is moved up and down by means of the pressure air supplied from the feed pipe 24 provided in the drilling pipe 29 to an air feed passage 25 provided in the casing 36 to impact against the bit 40. On the other hand, the air hammer drill 34 also includes in the lower end portion thereof a bit 44 which is likewise hit by a piston (not shown) 44. The bit is formed in the main body thereof with an axial air exhaust passage 46 and a radial air exhaust passage 48 and the air exhaust passage 48 is adapted to communicate with an air exhaust passage 50 located in the central portion of the air-pressure impact drilling apparatus 30. The air exhaust passage 50 is also communicating with an air exhaust passage (not shown) formed in the other drill bit 44. As shown in FIG. 3, the air exhaust passage 50 is further in communication with the air exhaust pipe 26 in the drilling pipe 29 so as to be able to vent air onto the ground.

On the other hand, the water discharge pipe 28 is connected to a water discharge passage 51 formed in the casing 36 and is divided from the intermediate position thereof into two sections which respectively form water discharge passages 52, 54. The water discharge passages 52, 54 respectively include openings 52A, 54A which, as shown in FIG. 5, are located adjancent to the bits 40, 44. In this structure, the earth and sand cut out by the bits 40, 44 are transported via the water discharge passages 52, 54 to the water discharge pipe 28 by a suction pump 66 provided on the ground, so that they can be collected onto the ground.

Each of the bits 40, 44, as shown in FIG. 5, is formed in a substantially fan-like shape. The bit 40 is provided with a projecting portion 40A and the bit 44 is formed with a recessed portion 44A into which the projecting portion 40A can be inserted. Therefore, the two bits 40, 44 are lowered in a manner that they are engaged with each other and thus mutually restricted by each other. Thus, even when the two bits are used in drilling through a cracked-rock zone or an uneven earth layer, there is no possibility that only one of them is lowered to fail to drill.

Further, between the air exhaust pipe 26 or air feed pipe 24 and the water discharge pipe 28 there is provided a check valve 60 which is used to discharge the earth using an air lift system. Specifically, in the case of FIG. 2, when the pressure within the air exhaust pipe 26 reaches or exceeds a predetermined level of pressure, the check valve 60 is then opened to feed a part of the air within the air exhaust pipe 26 into the water discharge pipe 28, so that the earth and sand can be sucked into the water discharge pipe 28. In this case, in order to adjust the air exhaust pressure, a valve or similar means may be provided in an exhaust line 74.

The air-pressure impact type drilling apparatus 30 constructed in the above-mentioned manner, in FIG. 1, is located within the casing pipe 62 for drilling. The water discharge pipe 28 is connected through a reverse line 64 to a suction pump 66, so that the sucked earth and sand are separated from the water and then the circulating water is again supplied into the casing pipe 62 by means of a water feed pipe 68. The air feed pipe 24 is connected through an air feed line 70 to an air compressor 72 so that the pressure air can be supplied. Also, the air exhaust pipe 26 is connected with an air exhaust line 74 so that the air used for operation of the piston can be exhausted from the air exhaust line 74. The above-mentioned method of discharging the earth is a water reverse (reverse circulation) system in which the earth and sand are sucked up together with the water. However, it is possible to employ a normal circulation system in which the water is supplied from the water exhaust pipe 28 to the bottom of a trench and the cutout slimes are discharged through a space between the wall of the trench and the drilling pipe. Also, when no water is present within the trench, another discharging method may be employed in which the earth and sand are discharged by the air supplied by a blower or a compressor.

The operation of the air-pressure impact drilling apparatus constructed in the above-mentioned manner is as follows: At first, the air supplied from the air feed pipe 24 fed into the air feed passage 25 to move up and down the piston 42 which in turn hits against the bits 40, 44 for drilling. The pressure air that has been already used to operate the piston 42 is conveyed through the air exhaust passages 46, 48 to the air exhaust pipe 50 and this exhaust air is then vented through the air exhaust pipe 26 onto the ground. And, the cutout earth and sand are sucked into the water discharge passages 52, 54 from the respective openings 52A, 54A thereof and are then passed through the water discharge pipe 28 to be collected onto the ground.

Figure 6:
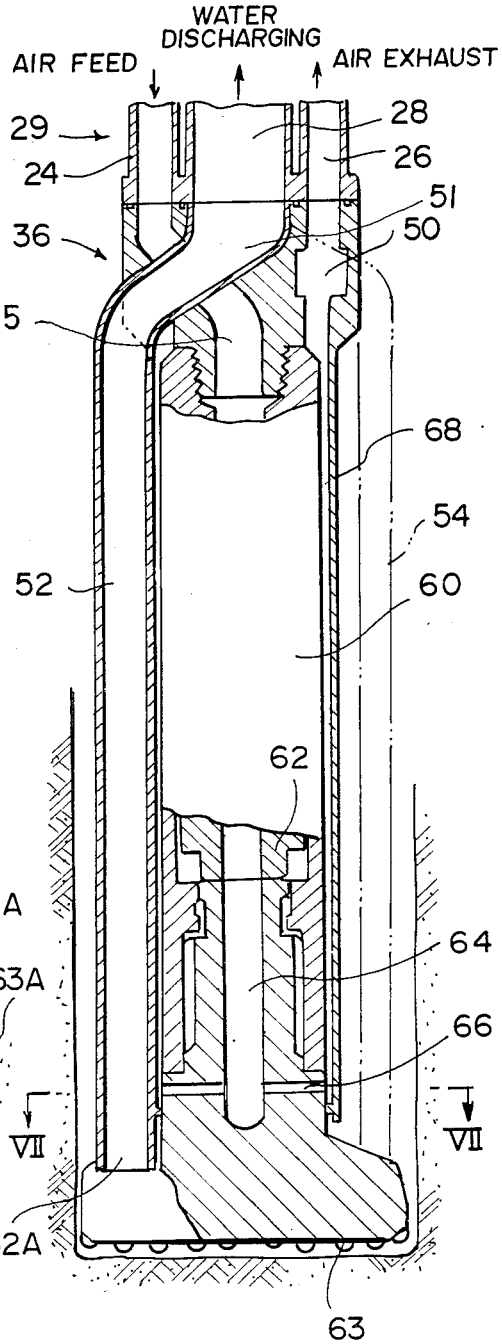
FIG. 6 is a section view to show the structure of a second embodiment of the air-pressure impact type drilling apparatus in accordance with the invention.
Figure 7:
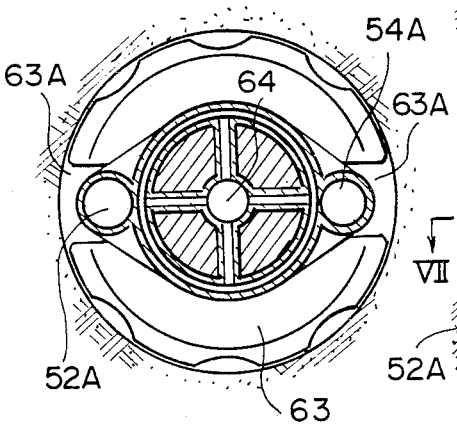
FIG. 7 is a section view taken along the line VII—VII in FIG. 6.

FIG. 6 is a section view to show the structure of another embodiment of an air-pressure impact type drilling apparatus according to the invention, and FIG. 7 is a section view taken along the line VII—VII in FIG. 6. In the embodiment shown in FIG. 6, like reference characters designate the same or similar parts as in the embodiment shown in FIG. 2 and thus the description thereof is omitted here. While in the embodiment of FIG. 2 the two air hammer drills 32, 34 are employed, in the embodiment shown in FIG. 6 a single air hammer drill 60 is used. In this air hammer drill 60 as well, the pressure air that is supplied from the air feed pipe 24 moves up and down a piston 62 to hit against a bit 53 and the pressure air, after used to operate the piston, is passed through air exhaust passages 64, 66, 68, 50 into the air exhaust pipe 26 and is then exhausted out onto the ground. Also, the openings 52A, 54A of the water discharge passages 52, 54 are respectively located in recessed portions 63A, 63A formed in the bit 63 to discharge the earth and sand cut out by the bit 63.

As discussed hereinbefore, according to the air-pressure impact type drilling method and an apparatus for the same of the invention, since there is provided a water discharge passage in the air hammer drill(s), a drilling operation of a large diameter can be performed efficiently by means of the reverse circulation system. Also, due to the fact that the pressure air that has been already used to move up and down the bit(s) is collected through the air exhaust passages within the casing, even under water of great depth a drilling can be carried out in an efficient manner without impairing the impact efficiency of the hammer drill(s) as well as regardless of the water head of the portion to be drilled.

Figure 8:
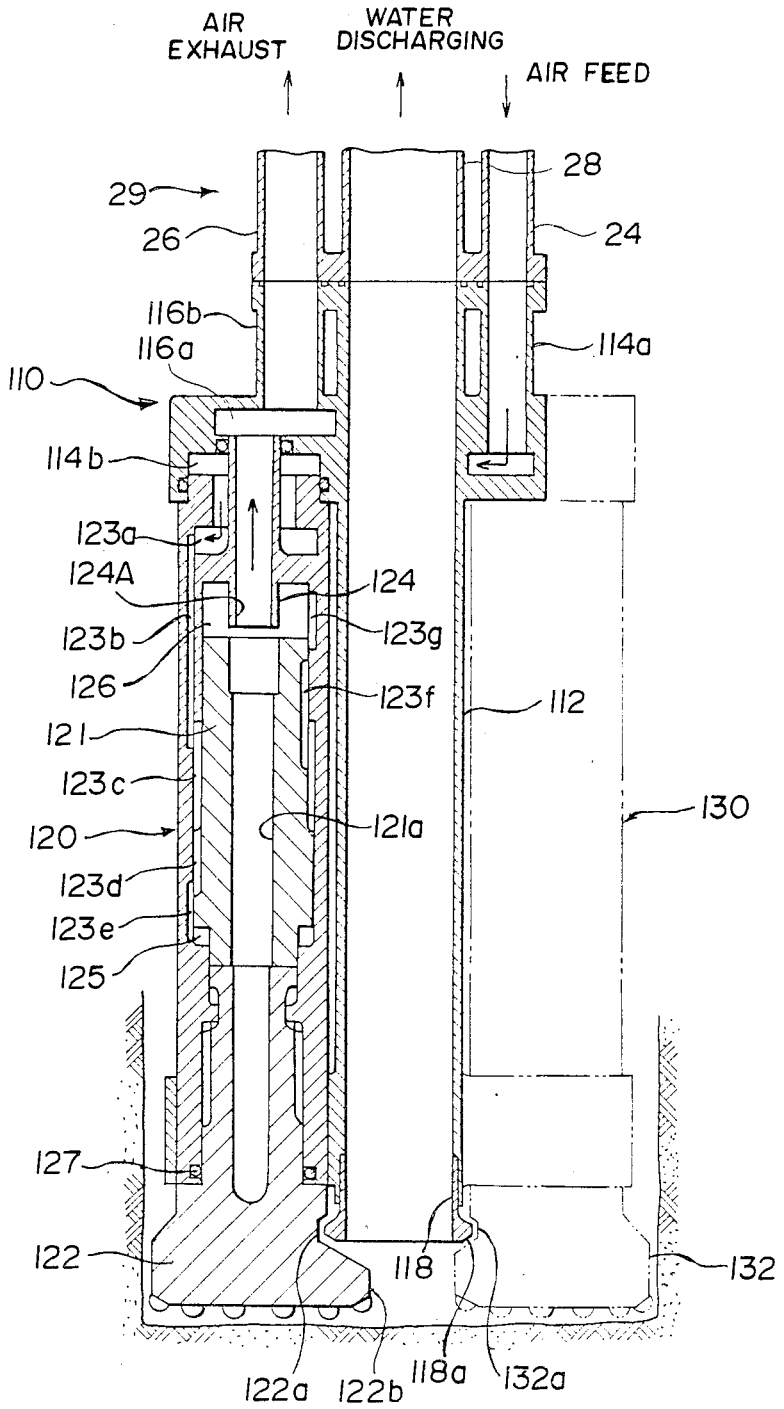
FIG. 8 is a section view of a third embodiment of the air-pressure impact type drilling apparatus in accordance with the invention.

Referring now to FIG. 8, there is shown a section view of a third embodiment of an air-pressure impact type drilling apparatus according to the invention. In FIG. 8, a casing 110 secures at least two air hammer drills 120, 130 to both sides of a water discharge passage 112. The air hammer drill 120 includes a hollow piston 121 and a bit 122 as well as it is provided with passages **123*a*–123*g*, a piston hollow portion 121*a*, an air exhaust hole 124, a first pressure chamber 125 and a second pressure chamber 126. The air hammer drill 120 further supports a bit 122 by means of spline connection or the like in such a manner that the bit 122 is free to slide a given amount of distance in the axial direction thereof. Between the outer peripheral members of the air hammer drill 120 and the bit 122 there is provided a seal member 127 to prevent the pressure air from leaking therefrom or to prevent the water in the trench from penetrating thereinto. Also, the above-mentioned passage 123*a* communicates with an air feed passage 114*b* of the casing 110 and the air exhaust hole 124 communicates with an air exhaust passage 116*a***.

The bits 122 and 132 in the air hammer drills 120 and 130 are respectively formed with recesses **122*a* and 132*a*. Also, there is provided a freely slidable hollow member 118 in the opening in the lower end of the water discharge passage 112. The hollow member 118 is provided in the outer periphery thereof with a projection 118*a* which can be fitted into the recesses 122*a*, 132*a* respectively formed in the bits 122, 132. The bit 122 is also equipped with a core cutter 122*b* which projects toward the center of the opening of the water discharge passage 112** to drill portions downwardly of the opening.

In the thus constructed wet-boring-type air-pressure impact drilling apparatus, at first, the pressure air fed from the air feed pipe 24 of the drilling pipe 29 is supplied via the air feed passages **114*a*, 114*b*, and passages 123*a*, 123*b*, 123*c*, 123*d*, 123*e* to the first pressure chamber 125. When the pressure within the first pressure chamber 125 reaches a high level, then the high pressure moves the piston 121** upwardly.

When the piston 121 is moved further upwardly by the pressure of the first pressure chamber 125 and the upward force of inertia of the piston 121, then the communication between the passages 123*d* and 123*e* is cut off by the lower portion of the piston 121 so that the pressure air is not supplied to the first pressure chamber 125, while the isolation between the passages 123*f* and 123*g* by the upper portion of the piston 121 is removed by the upward movement of the piston 121 to provide a communicative connection therebetween so that the pressure air is now supplied to the second pressure chamber 126 via the annular passage 123*c* and passages 123*f*, 123*g*. Also, the first pressure chamber 125 is now brought into communication with the hollow portion 121*a* of the piston 121, and thus the air (exhaust air) within the first pressure chamber 125 after used for operation of the piston 121 can be exhausted into the exhaust pipe 26 through the piston hollow portion 121*a*, air exhaust hole 124, and air exhaust passages 116*a*, 116*b*.

When the upper portion of the piston hollow portion 121*a* is engaged with the tubular body 124A of the exhaust hole 124, then the air exhaust passage of the second pressure chamber 126 is cut off and thus the pressure within the second pressure chamber is increased by the pressure air supplied. When the pressure within the second pressure chamber surpasses the rising force of the piston 121, then the piston 121 is moved back downwardly.

When the piston 121 is moved further downwardly by the pressure of the second pressure chamber 126 and the downward inertia force of the piston 121, the communication between the passages 123*f* and 123*g* is cut off by the upper portion of the piston 121 to stop supply of the pressure air into the second pressure chamber 126, while the passages 123*d* and 123*e* that have been cut off from each other by the lower portion of the piston 121 are now allowed to communicate with each other so that the pressure air can be now supplied to the first pressure chamber 125. Also, the second pressure chamber 126 is now brought into communication with the air exhaust hole 124, so that the exhaust air within the second pressure chamber 126 that has already been used to operate the piston can be exhausted to the air exhaust pipe 26 through the air exhaust hole 124 and air exhaust passages 116*a*, 116*b*.

In this manner, the supply and exhaust of the pressure air into and from the first and second pressure chamber 125 and 126 are repeated successively, and thus the piston 121 is moved up and down successively to thereby hit against the bit 122 successively. Also, due to the fact that there is arranged the seal 127 in the engaged portion of the air hammer drill 120 and bit 122, the water within the trench is prevented from penetrating thereinto, with the result that the operation of the air hammer drill 120 will not be disturbed as well as the impact force of the air hammer will not be reduced. Further, since the pressure air acts on the bit axis side on the back surface side of the seal 127 to thereby reduce the pressure difference relative to the water head pressure, the durability of the seal 127 can be increased even when it is used under water of a great depth. Although an air hammer drill 130 is different in shape slightly from the air hammer drill 120, the other remaining structures and operation of the air hammer drill 130 are identical with the air hammer drill 120 and thus the detailed description thereof is omitted here. In FIG. 8, although the central portion of the bit is formed with a hole extending centrally thereof and up to the intermediate position thereof, according to the invention, since the exhaust air will not be vented from the bit, the bit may be formed with no hole.

When the bits 122, 132 of the air hammer drill 120, 130 are hit, since the recessed portions 122*a*, 132*a* in these bits are respectively engaged with the projections 118*a* of the hollow member 118, the respective bits are restricted in their respective axial movements and are moved substantially similarly to each other.

Also, the earth and sand cut out by the bits 122, 132 are sucked up together with the water by a suction pump or the like via the hollow member 118 and water discharge passage 112, are passed through the water discharge pipe 28, and finally are collected onto the ground. In the present embodiment, there is illustrate a so called reverse circulation method of discharging the cutout substances. However, according to the present apparatus, there can be employed a normal circulation method in which water is supplied via the water discharge passage 112 from the ground to the bottom of the trench using a pump to push up the cutout substances for discharging thereof.

Figure 9:
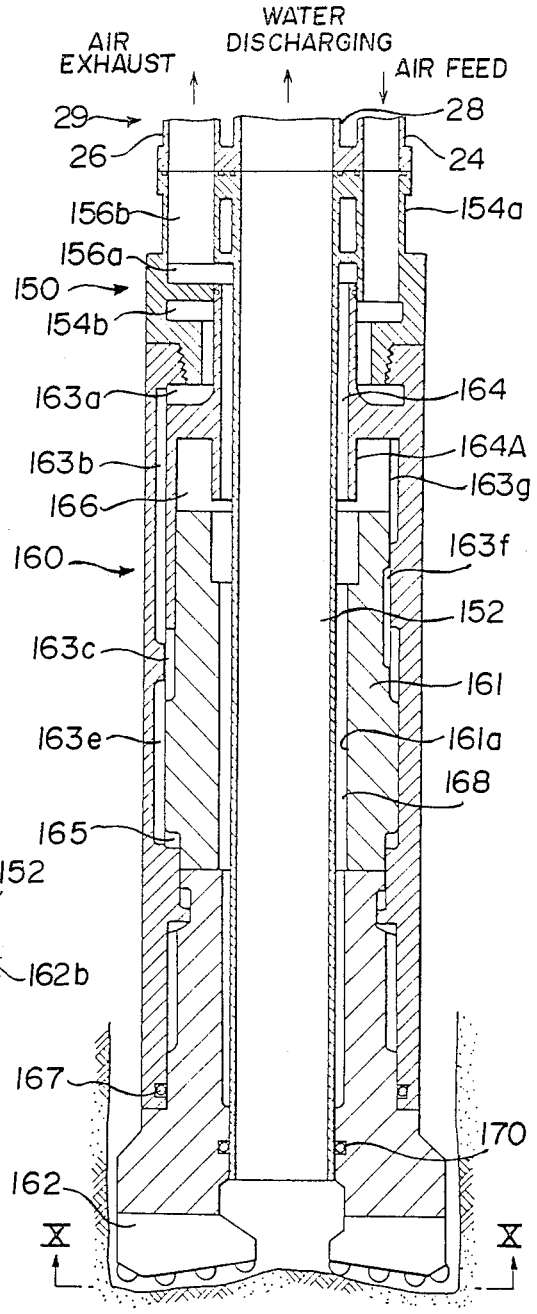
FIG. 9 is a section view of a fourth embodiment of the air-pressure impact type drilling apparatus in accordance with the invention.
Figure 10:
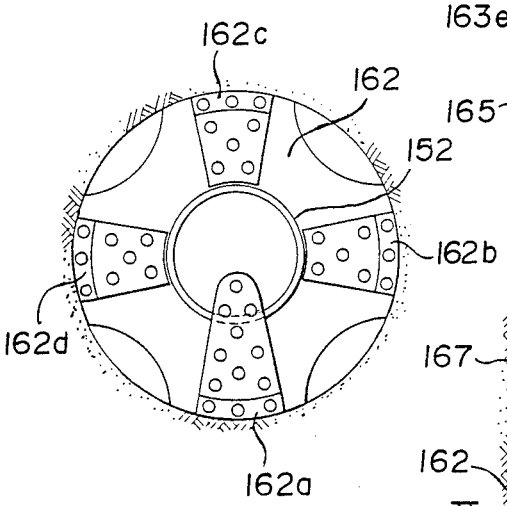
FIG. 10 is a section view taken along the line IX—IX in FIG. 9.

FIG. 9 is a section view to show a fourth embodiment of a wet-boring-type air-pressure impact drilling apparatus according to the invention, in which a single air hammer drill is employed. Also, FIG. 10 is a section view taken along the line X—X in FIG. 9.

In FIG. 9, a casing 150 includes a water discharge passage 152 in the central portion thereof as well as air feed passages 154*a*, 154*b* for supplying the pressure air to an air hammer drill 160 and air exhaust passages 156*a*, 156*b* for venting out the exhaust air from the air hammer drill 160. This casing 150, as with the casing 110 in FIG. 8, is located in the lower end of the drilling pipe 29 and is also adapted to support the air hammer drill 160.

The air hammer drill 160 includes not only a hollow piston 161 and a hollow bit 162 but also passages 163*a*~163*g*, the hollow portion 161*a* of the piston 161, an air exhaust hole 164, a tubular body 164*a* in the air exhaust hole, a first pressure chamber 165, and a second pressure chamber 166. The air hammer drill 160 supports the bit 162 by means of spline connection or the like in such a manner that the bit 162 can be slided a given amount of distance in the axial direction thereof, and there is provided a seat member 167 between the outer peripheral members of the air hammer drill 160 and the bit 162.

The water discharge passage 152, air feed passages 154*a*, 154*b*, and air exhaust passages 156*a*, 156*b* in the casing 150 as well as the passages 163*a*~163*g*, first pressure chamber 165 and second pressure chamber 166 in the air hammer drill 160 are equivalent to the water discharge passage 112, air feed passages 114*a*, 114*b* and air exhaust passages 116*a*, 116*b* in the casing 110 as well as the passages 123*a*~123*g*, first pressure chamber 125 and second pressure chamber 126 in the air hammer drill 120 in FIG. 8, respectively, and, therefore, the detailed description thereof is omitted here.

The apparatus shown in FIG. 9 is different from the apparatus in FIG. 8 in that, since the water discharge passage 152 is formed such that it extends through the central portion of the air hammer drill 160, an annular passage 168 defined by the piston hollow portion 161*a*, the tubular body 164*a* of the air exhaust hole 164, and the water discharge passage 152, and the air exhaust hole 164 respectively provide passages for the exhaust air, and in that the seal member 170 is provided between the bit 162 and the water discharge passage 152. Also, the bit 162 is a single bit which, as shown in FIG. 10, includes four cutting edge portions 162a~162d, and, among the four cutting edge portions, the cutting edge portion 162a is adapted to project toward the center of the opening of the water discharge passage 152 to provide a projection for drilling a portion of the earth downwardly of the opening.

As discussed above, according to the wet-boring-type air-pressure impact drilling apparatus of the invention, since the air exhaust means are provided in the upper portion thereof, and also no air exhaust means are formed on the side surfaces of the bit shaft, the present apparatus is simple in structure, as well as it can provide a sufficient strength even when the diameter of the bit portion to be sealed is reduced to a relatively smaller size. As a result of this, the back pressure acting on the bit due to the water head pressure can be decreased to thereby minimize the loss of energy, and also the pressure difference in the seal portion is reduced to thereby enhance the seal performance (effect) of the apparatus.

Figure 11:
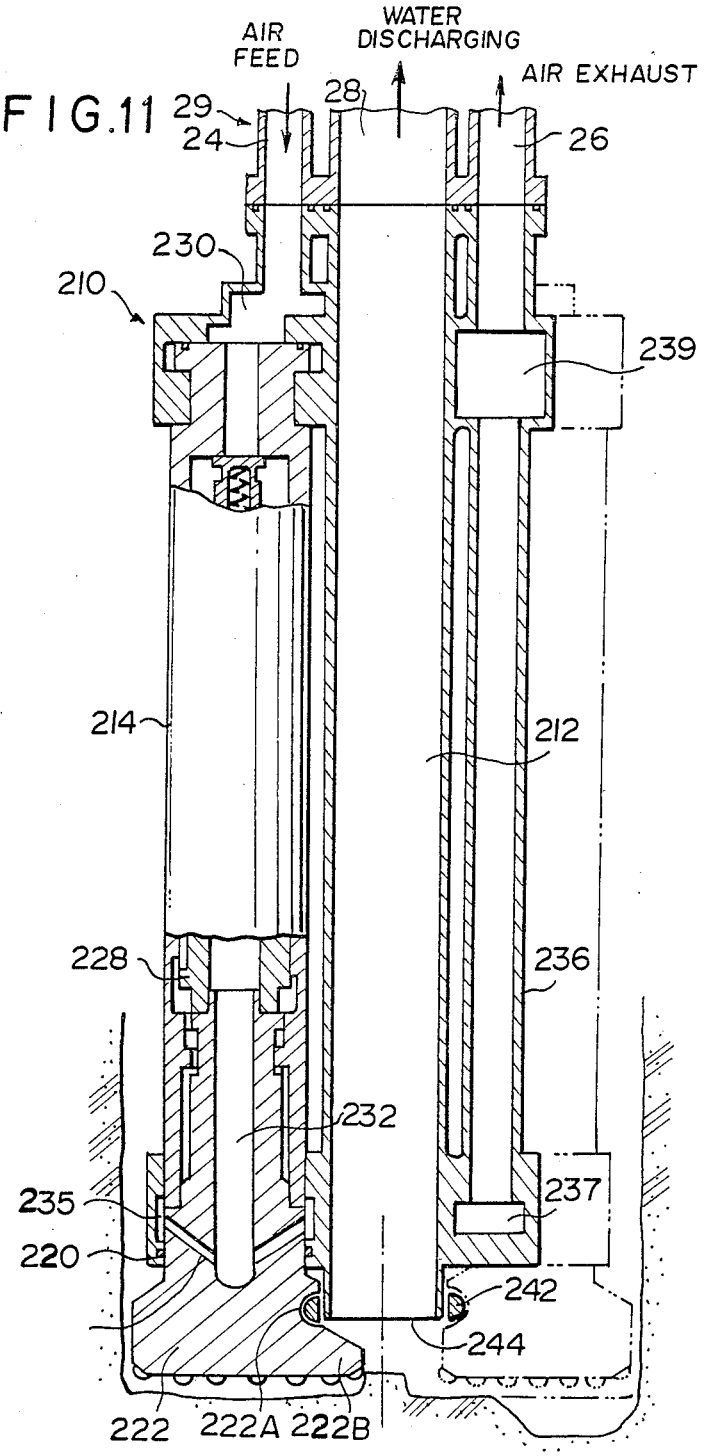
FIG. 11 is a section view to show the structure of an air-pressure impact type drilling apparatus in accordance with the invention.
Figure 12:
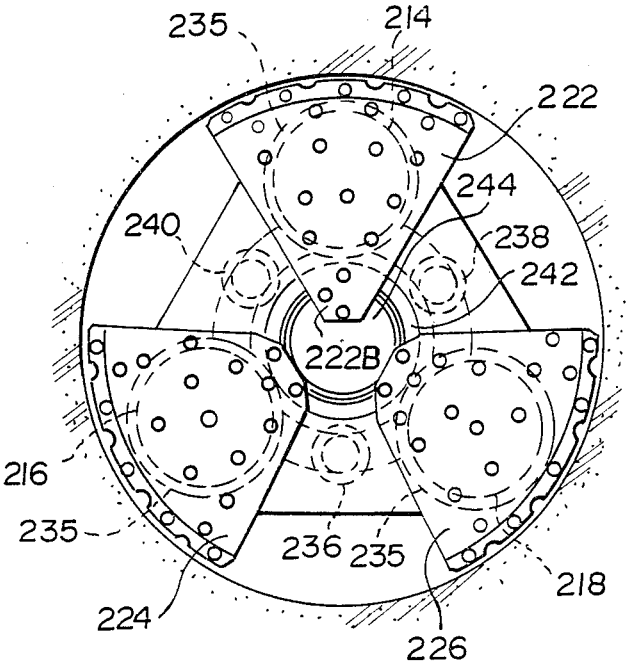
FIG. 12 is a bottom view of the air-pressure impact type drilling apparatus shown in FIG. 11.

Referring now to FIG. 11, there is shown a section view of a fifth embodiment of an air-pressure impact drilling apparatus constructed in accordance with the invention which employs three air hammer drills and three bits respectively corresponding to the air hammer drills. FIG. 12 is a bottom view of the fifth embodiment of the drilling apparatus of the invention shown in FIG. 11.

In FIG. 11, a casing 210 includes in the central portion thereof a water discharge passage 212 communicating with a water discharge pipe 28 of a drilling pipe 29 and also secures three air hammer drills 214, 216, 218 (FIG. 12) around the water discharge passage 212. The lower end portion of the air hammer drill 214 with a seal member 220 is fixed to the lower portion of the casing 210 and supports a bit 222 through spline connection or similar means in such a manner that the bit can be slided freely a given amount of distance in the axial direction thereof, upwardly of which bit 222 is located a piston 228 that can be moved up and down by means of the pressure air. It should be noted that, although not shown, other two air hammer drills 216, 218 are similar in structure to the air hammer drill 214.

Also, the casing 210 is provided with not only an air feed passage communicating with the air feed pipe 24 of the drilling pipe 29 for supplying the pressure air from the air feed pipe 24 to the respective air hammer drills but also an air exhaust passage for venting the exhaust air already used for operation of the pistons of the respective air hammer drills through passages 232, 234 in the bit, annular passages 235, 237 formed parallel to each other in the casing 210, three air exhaust passages 236, 238, 240 (FIG. 12), and an upper annular passage 239 to the air exhaust pipe 26 of the drilling pipe 29.

The bits 222, 224, 226 are formed in the side surfaces thereof with recessed portions 222A, 224A, 226A, respectively, a ring-shaped interference member 242 is loosely fitted into the recessed portions 222A, 224A, 226A, and the lower portion of the water discharge passage 212 extends down to the interference member 242. The interference member 242 is free to slide in the axial direction of the water discharge passage 212 and it interferes with the respective bits 222, 224, 226 such that they restrict one another in the amount of movement in the axial direction thereof. The bit 222 is also extended toward the center of the water discharge passage 212 but downwardly of the suction opening 244 of the water discharge passage 212 and is provided with a core cutter 222B for drilling a portion of the earth lying downwardly of the suction opening 244.

In the air-pressure impact drilling apparatus constructed in the above-mentioned manner, at first, the pressure air that is supplied from the air feed pipe 24 is fed via the air feed passage 230 to the respective air hammer drills 214, 216, 218 to move up and down the pistons of the respective air hammer drills, causing the pistons to hit against the associated bits 222, 224, 226 for drilling. During this drilling operation, the core cutter 222B of the bit 222 is operated together with the bit 222 to thereby drill the portion of the earth lying downwardly of the suction opening 244 of the water discharge passage 212. This eliminates the possibility that any uncut portion is left in the central portion of the earth lying downwardly of the suction opening 244. Also, since the recessed portions 222A, 224A, 226A in the bits 222, 224, 226 are respectively in loose fit with the projection 242A, the bits are restricted by one another in the axial movements thereof and thus their movements are substantially similar to one another. Further, the earth and sand cut out are sucked in via the water discharge passage 212 together with the water by a suction pump or similar means, are then passed through the water discharge pipe 28, and finally are collected onto the ground. In this case, since the suction opening 244 at the lower end of the water discharge passage 212 extends down to the interference member 242, the sucking force of the suction opening is so great that even large stones or the like can be sucked in.

In addition, the pressure air that has already been used to operate the pistons is collected via the passages 232, 234 in the bits, the annular passages 235, 237 provided parallel in the casing 210, the three air exhaust passages 236, 238, 240 and the upper annular passage 239 to the air exhaust pipe 26 and is finally vented onto the ground.

As described above, according to the air-pressure impact drilling apparatus of the invention shown in FIG. 12, there is provided the water discharge passage in the air-pressure impact drilling apparatus, a portion of each of the air hammer drill bit is formed such that it extends toward the center of the water discharge passage lying downwardly of the suction opening of the water discharge passage, and the earth and sand lying downwardly of the water discharge passage can be cut out by the core cutter of the bit, whereby, even when the water discharge passage is formed in the central portion of the casing around which the air hammer drills are secured, there is no possibility that any uncut portion may be left downwardly of the water discharge passage and also that the water discharge passage may be choked with conglomerates, so that the earth can be discharged and cut out in an efficient manner.

Figure 13:
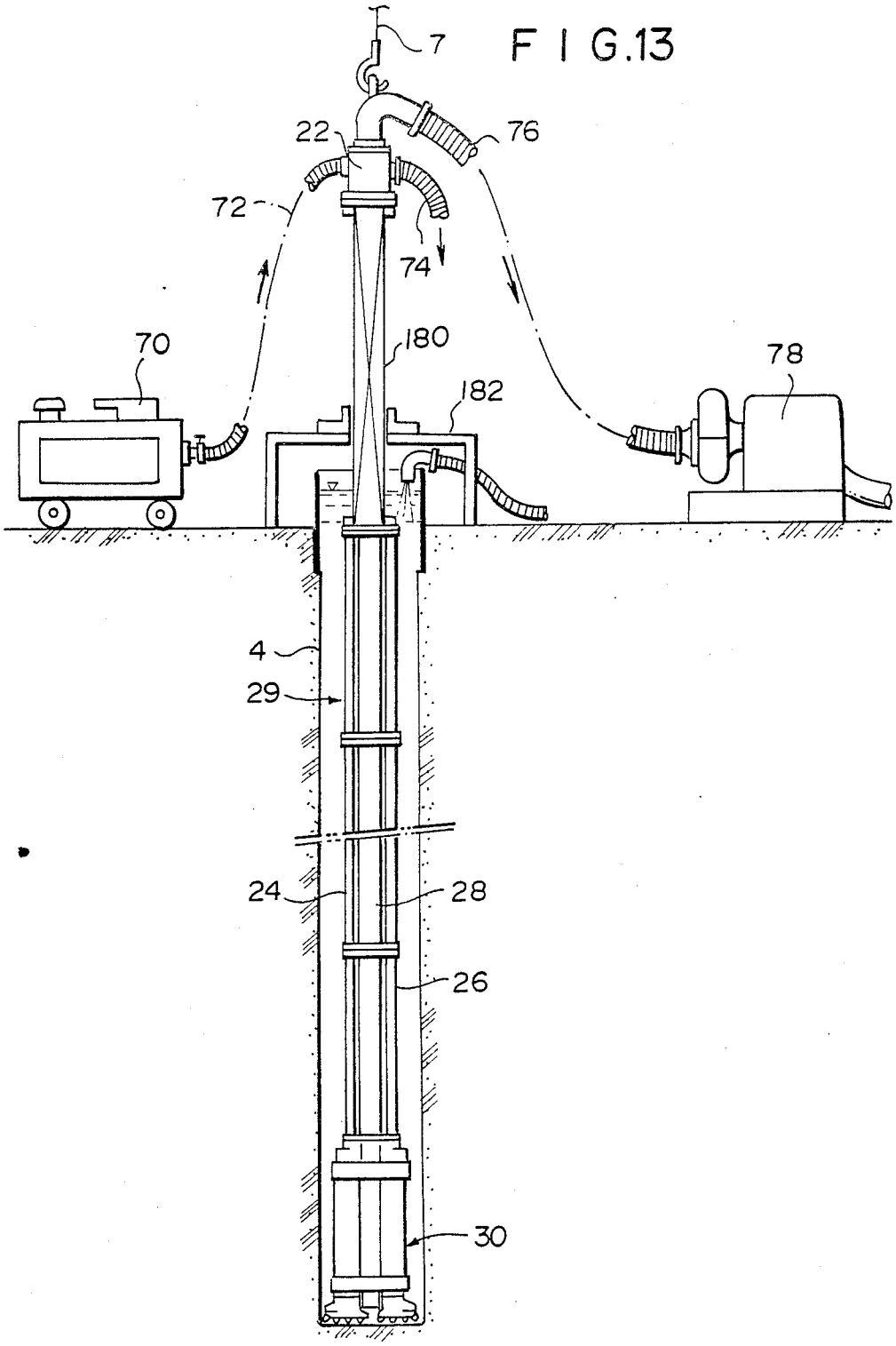
FIG. 13 is another working view of an air-pressure impact type drilling apparatus in accordance with the invention.

Referring now to FIG. 13, there is shown another working view of of the air-pressure impact drilling apparatus according to the invention. As shown in FIG. 13, the air compressor 70, supply line 72, swivel device 80, suction pump 78 and reverse line 76 provided on the ground are similar in construction to those as shown in FIG. 1, respectively. The drilling pipe 29 shown in FIG. 13 is connected via a kelly rod 180 to the swivel device 80. The kelly rod 180 is formed in a quadrangular section and is also provided therein with an air feed passage, an air exhaust passage and a water discharge passage (although they are not shown in the drawings). The kelly rod 180 can be rotatively driven by a rotary table 182 on the ground. That is, the rotational driving of the rod causes the air-pressure impact drilling apparatus 30 to be rotated through the drilling pipe 29. Also, the swivel device 80 is suspended via a rope 7 by a crane.

In this working construction as well, as in the working construction shown in FIG. 1, the air-pressure impact type drilling apparatus 30 can be mounted properly as well as the earth and sand can be cut out efficiently.

Figure 14:
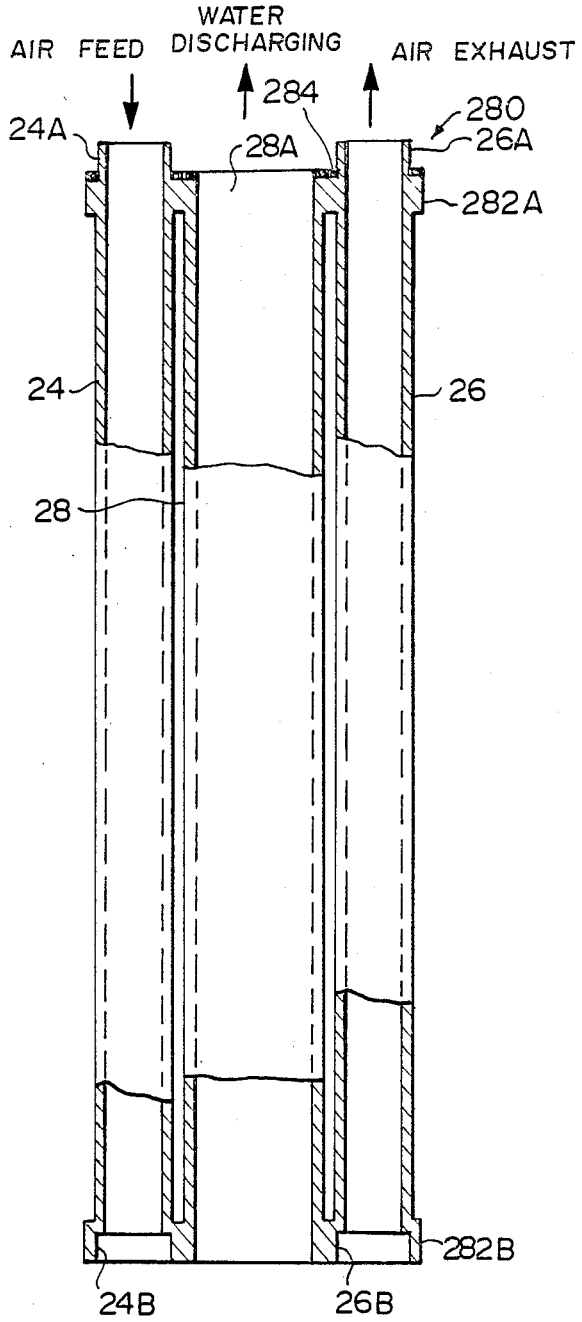
FIG. 14 is a section view of a unit drilling pipe used in an air-pressure impact type drilling method and an apparatus for the same in accordance with the invention; and, FIG. 15 is a section view of the main portions of a power swivel device employed in an air-pressure impact type drilling method and an apparatus for the same in accordance with the invention.

Referring now to FIG. 14, there is shown a longitudinal section view of the drilling pipe 29 which is employed in the air-pressure impact type drilling method and apparatus for the same according to the invention. The drilling pipe 29 of the present air-pressure impact type drilling apparatus, as shown in FIG. 14, comprises a water discharge pipe 28 of a given strength, an air feed pipe 24 having the same length with the water discharge pipe 28, and an air exhaust pipe 26 formed greater in diameter than the air feed pipe 24 and having the same length with the water discharge pipe 28, while the above-mentioned pipes are connected to one another by means of upper and lower flanges 282A and 282B respectively provided in the upper and lower end portions of the drilling pipe 29. Also, in the drilling pipe 29, seal members 284 --- are respectively provided in the upper flange 282A. Further, in the drilling pipe 29, the air feed pipe 24 and air exhaust pipe 26 respectively include upper end portions 24A, 26A which are projected upwardly of the upper end portion 28A of the water discharge pipe 28 and are also connected to the lower flange of an upper drilling pipe (not shown) via the flange 282A. On the other hand, in the lower flange 282B that corresponds to the respective lower end portions of the air feed pipe 24 and the air exhaust pipe 26, there are provided engagement portions 24B and 26B into which the above-mentioned projected upper end portions 24A and 26A of the air feed pipe 24 and exhaust pipe 26 of the drilling pipe 29 are respectively fitted.

Therefore, in the drilling pipe 29 employed in the air-pressure impact type drilling apparatus shown in FIG. 14, since the upper end portions 24A, 26A of the air feed pipe 24 and the air exhaust pipe 26 are projected upwardly of the upper end portion 28A of the water discharge pipe 28, when the drilling pipe 29 is separated, there is no possibility that the muddy water running over the brim of the water discharge pipe 28 may flow into the air feed pipe 24 and the air exhaust pipe 26. Also, in the present drilling pipe, since the air exhaust pipe 26 is greater in diameter than the air feed pipe 24, the pressure air can be exhausted easily, resulting in the enhanced drilling efficiency of the air-pressure impact type drilling apparatus 30.

Figure 15:
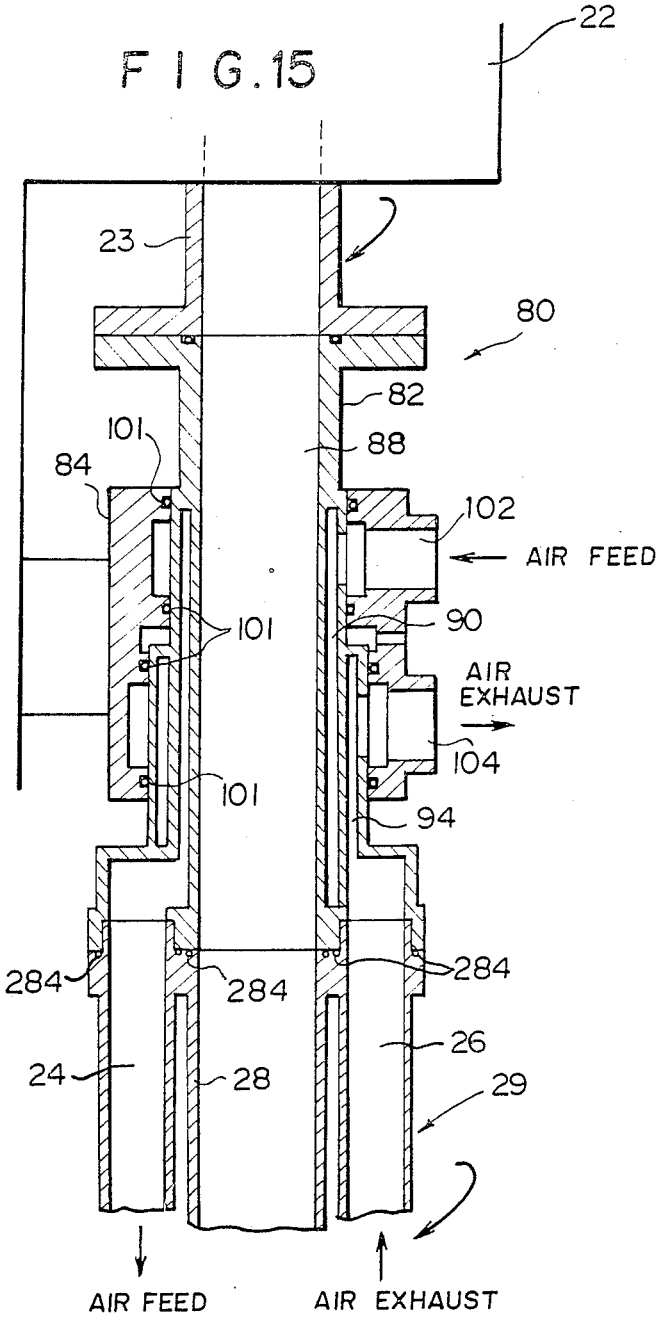

FIG. 15 is a section view of the swivel device 80, illustrating the mounting portion between the rotary drive device 22 and the drilling pipe 29. The swivel device 80 comprises a rotary body 82 mounted to a drive pipe 23 of the rotary drive device 22, and a support body 84 fixed to the rotary drive device 22 to support the outer peripheral surface of the rotary body 82 in such a manner that the rotary body 82 is free to rotate. The drilling pipe 29 is connected via a seal member 284 to the lower end of the rotary body 82. Through this construction, the drilling pipe 29 can be rotated by the rotary body 82 which is driven by a drive pipe 23.

The rotary body 82 is formed in the central portion thereof with a water discharge passage 88 extending therethrough, the lower end of the water discharge passage 88 is connected to the water discharge pipe 28, and the upper end of the water discharge passage 88 is connected via the drive pipe 23 and, as shown in FIG. 1, the reverse line 64 to a suction pump 66. Also, between the rotary drive device 22 and the reverse line 64, there is provided a swivel mechanism for water discharging (not shown). The rotary body 82 is also formed with an air feed passage 90 disposed outside the water discharge passage 88, and this air feed passage 90 is connected with the air feed pipe 24 of the drilling pipe 29. In a portion of the outer peripheral surface of the rotary body 82 there is formed an air feed opening 102 of the air feed passage 90. Also, outside of the air feed passage 90 of the rotary body 82 there is formed an air exhaust passage 94 which is in turn connected to the air exhaust pipe 26 of the drilling pipe 29. In a portion of the outer peripheral surface of the rotary body 82 there is formed an air exhaust opening 104 for the air exhaust passage 94. There is provided a seal member 101 on the rotary sliding contact surface between the rotary body 82 and the support body 84 to seal the two bodies in an airtight condition. The air feed opening 102 is connected through the air supply line 70 shown in FIG. 1 to the air compressor 72 from which the pressure air is supplied. The air exhaust opening 104 is connected to the air exhaust line 74 shown in FIG. 1 from which the air that has been used to operate the piston of the air-pressure impact type drilling apparatus 30 can be vented out.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An air-pressure impact type drilling apparatus comprising:

an air hammer drill including a cylinder member for slidably supporting a hollow bit in an axial direction thereof by a forward end portion thereof provided with a seal member, a piston supported in the axial direction thereof in said cylinder member and having a hollow central portion for giving impacts to said bit by a bottom end portion thereof, an air pressure feed passage to be alternately communicated with pressure chambers provided at the top and bottom of said piston in accordance with the vertical movement of said piston, an air exhaust passage to be alternately communicated with said pressure chambers provided at the top and bottom of said piston in accordance with vertical movement of said piston to discharge the air used for the vertical movement of said piston, and a water discharge passage opened at a position close to said bit, for discharging cutout substances cut out by said bit together with the water, said water discharge passage extending through said hollow piston and supported by a central portion of said bit through a seal;

a drilling pipe parallelly provided therein with an air feed pipe, an air exhaust pipe and a water discharge pipe to be communicated with and connected to an air feed passage, an air exhaust passage and a water discharge passage of said air hammer drill, respectively;

a swivel device for rotatably supporting said drilling pipes and provided with a passage communicated with the pipes constituting said drilling pipe;

connecting flanges formed at opposite ends of said drilling pipe; and a seal member provided on the surface of one of said flanges.

2. An air-pressure impact type drilling apparatus as set forth in claim 1, wherein a portion of a cutter of said bit is extended to a generally central position downwardly of an opening of said water discharge passage.

3. An air-pressure impact type drilling apparatus comprising:

an air hammer drill including a cylinder member for slidably supporting a hollow bit in an axial direction thereof by a forward end portion thereof provided with a seal member, a piston supported in the axial direction thereof in said cylinder member and having a hollow central portion for giving impacts to said bit by a bottom end portion thereof, an air pressure feed passage to be alternately communicated with pressure chambers provided at the top and bottom of said piston in accordance with the vertical movement of said piston, an air exhaust passage to be alternately communicated with said pressure chambers provided at the top and bottom of said piston in accordance with vertical movement of said piston to discharge the air used for the vertical movement of said piston, and a water discharge passage opened at a position close to said bit, for discharging cutout substances cut out by said bit together with the water, said water discharge passage extending through said hollow piston and supported by a central portion of said bit through a seal;

a drilling pipe parallelly provided therein with an air feed pipe, an air exhaust pipe and a water discharge pipe to be communicated with and connected to an air feed passage, an air exhaust passage and a water discharge passage of said air hammer drill, respectively; and a swivel device for rotatably supporting said drilling pipes and provided with a passage communicated with the pipes constituting said drilling pipe, said swivel device including a rotatable member connected at one end thereof to a rotatably driving device for rotation and connected at the other end to said drilling pipe and a support member for rotatably supporting the outer periphery of said rotatable member, said rotatable member being formed in the central portion thereof with a through hole communicated with the air discharge pipe of said drilling pipe, one or more fluid passages communicated with the air feed pipe of said drilling pipe being formed on the outer periphery of the through-hole of said rotatable members, and the fluid passage or passages of said rotatable member being communicated with one or more fluid passages provided in said support member.

4. An air-press impact type drilling apparatus comprising:

a multi-air hammer drill including a plurality of cylinder members for slidably supporting bits in the axial direction thereof by the forward end portions thereof each having a seal member, pistons slidably supported in the axial direction thereof in said cylinder members, for giving impacts to said bits by the bottom end portions thereof, a casing for parallelly binding said plurality of cylinder members, air feed passages to be alternately communicated with pressure chambers provided at the top and bottom of said pistons of said plurality of cylinder members in accordance with the vertical movements of said piston, air exhaust passages to be alternately communicated with the pressure chambers provided at the top and bottom of said pistons in accordance with the vertical movements of said pistons to discharge the air used for the vertical movements of said pistons, and a water discharge passage formed on said casing, and opened at positions close to said bits, for discharging cutout substances cut out by said bits together with the water;

a drilling pipe parallelly provided with an air feed pipe, an air exhaust pipe and a water discharge pipe, which are communicated with and connected to the air feed passages, the air exhaust passages and the water discharge passage of said multi-air hammer drill through seal members;

a swivel device having passages communicated with the pipes constituting said drilling pipe;

connecting flanges formed on opposite ends of said drilling pipe; and a seal member provided on the surface of one of said flanges.

5. An air-pressure impact type drilling apparatus as set forth in claim 4, wherein said plurality of cylinder members are parallelly bound with the water discharge passage being placed at the center.

6. An air-pressure impact type drilling apparatus as set forth in claim 4, wherein a portion of a cutter of said bit is extended to a generally central portion downwardly of an opening of said water discharge passage.

7. An air-pressure impact type drilling apparatus comprising:

a plurality of air hammer drills connected parallel to one another to a casing and, as a whole, rotatable and lowerable, each having a bit to be hit by a piston which can be moved up and down by the pressure air that is supplied alternately to upper and lower pressure chambers;

an air feed passage for supplying said pressure air into said air hammer drills to move up and down said piston;

an air exhaust passage communicating with said air feed passage to exhaust onto the ground the air that has already been used for operation of said piston;

a water discharge passage having an opening adjacent to said bits to collect earth and sand cut out by said bits; and means provided between said bits for engaging said bits to move up and down said bits in synchronism, said engaging means being formed such that a projection is formed on one side of said bit and a recess for receiving said projection is formed on the other side of said bit.

8. An air-pressure impact type drilling apparatus comprising:

a plurality of air hammer drills connected parallel to one another to a casing and, as a whole, rotatable and lowerable, each having a bit to be hit by a piston which can be moved up and down by the pressure air that is supplied alternately to upper and lower pressure chambers;

an air feed passage for supplying said pressure air into said air hammer drills to move up and down said piston;

an air exhaust passage communicating with said air feed passage to exhaust onto the ground the air that has already been used for operation of said piston;

a water discharge passage having an opening adjacent to said bits to collect earth and sand cut out by said bits; and means provided between said bits for engaging said bits to move up and down said bits in synchronism, said engaging means being a hollow member coupled into a space formed between said bits.

9. An air-pressure impact type drilling apparatus comprising:

a multi-air hammer drill including a plurality of cylinder members for slidably supporting bits in the axial direction thereof by the forward end portions thereof each having a seal member, pistons slidably supported in the axial direction thereof in said cylinder members, for giving impacts to said bits by the bottom end portions thereof, a casing for parallelly binding said plurality of cylinder members, air feed passages to be alternately communicated with pressure chambers provided at the top and bottom of said pistons of said plurality of cylinder members in accordance with the vertical movements of said piston, air exhaust passages to be alternately communicated with the pressure chambers provided at the top and bottom of said pistons in accordance with the vertical movements of said pistons to discharge the air used for the vertical movements of said pistons, and a water discharge passage formed on said casing, and opened at positions close to said bits, for discharging cutout substances cut out by said bits together with the water;

a drilling pipe parallelly provided with an air feed pipe, an air exhaust pipe and a water discharge pipe, which are communicated with and connected to the air feed passages, the air exhaust passages and the water discharge passage of said multi-air hammer drill through seal members; and a swivel device having passages communicated with the pipes constituting said drilling pipe, said swivel device including a rotatable member connected to one end thereof to a rotatable driving device for rotation and connected at the other end thereof to said drilling pipe and a support member for rotatably supporting the outer periphery of said rotatable member, said rotatable member is formed in the central portion thereof with a through-hole communicated with the water discharge pipe of said drilling pipe, and one or more fluid passage communicated with the air feed pipe of said drilling pipe being formed on the outer periphery of the through-hole of said rotatable member, and the fluid passage or passages of said rotatable member being communicated with one or more fluid passages provided in said support member.

* * * * *